US007486776B2

(12) United States Patent
Andrews et al.

(10) Patent No.: US 7,486,776 B2
(45) **Date of Patent: *Feb. 3, 2009**

(54) SHIELD STRUCTURE AND FOCAL SPOT CONTROL ASSEMBLY FOR X-RAY DEVICE

(75) Inventors: Gregory C. Andrews, Draper, UT (US); James R. Boye, Salt Lake City, UT (US)

(73) Assignee: Varian Medical Systems, Inc., Palo Alto, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/751,603

(22) Filed: May 21, 2007

(65) Prior Publication Data

US 2008/0019483 A1 Jan. 24, 2008

Related U.S. Application Data

(63) Continuation of application No. 10/933,806, filed on Sep. 3, 2004, now Pat. No. 7,289,603.

(51) Int. Cl.
*H01J 35/14* (2006.01)

(52) U.S. Cl. ..... 378/138; 378/121

(58) Field of Classification Search ..... 378/119, 378/121, 137, 138, 140, 141
See application file for complete search history.

(56) References Cited

U.S. PATENT DOCUMENTS 6,907,110 B2 * 6/2005 Apel et al. ..... 378/143
7,289,603 B2 * 10/2007 Andrews et al. ..... 378/138

* cited by examiner

*Primary Examiner*—Courtney Thomas
(74) *Attorney, Agent, or Firm*—Workman Nydegger

(57) ABSTRACT

A shield structure and focal spot control assembly is provided for use in connection with an x-ray device that includes an anode and cathode disposed in a vacuum enclosure in a spaced apart arrangement so that a target surface of the anode is positioned to receive electrons emitted by the cathode. The shield structure is configured to be interposed between the anode and the cathode and includes an interior surface that defines an aperture or other opening through which the electrons are passed from the cathode to the target surface of the anode. Additionally, fluid passageways defined in connection with the shield structure enable cooling of the shield structure. Finally, a magnetic device disposed proximate the cathode facilitates control of the location of the focal spot on the target surface of the anode.

12 Claims, 5 Drawing Sheets

SHIELD STRUCTURE AND FOCAL SPOT CONTROL ASSEMBLY FOR X-RAY DEVICE

RELATED APPLICATIONS

The present application is a continuation application of U.S. patent application Ser. No. 10/933,806, filed Sep. 3, 2004, which is incorporated herein by reference in its entirety.

BACKGROUND OF THE INVENTION

1. Field of the Invention

The present invention relates generally to x-ray systems and devices. More particularly, embodiments of the invention concern an x-ray device shield structure and focal spot control assembly that contributes to improved x-ray device performance, through enhanced heat management within the x-ray device and by way of focal spot control.

2. Related Technology

X-ray systems and devices are valuable tools that are used in a wide variety of applications, both industrial and medical. For example, such equipment is commonly used in areas such as diagnostic and therapeutic radiology, semiconductor manufacture and fabrication, and materials analysis and testing.

While used in a number of different applications, the basic operation of x-ray devices is similar. In general, x-rays are produced when electrons are produced and released, accelerated, and then stopped abruptly. A typical x-ray device includes an x-ray tube having a vacuum enclosure collectively defined by a cathode cylinder and an anode housing. An electron generator, such as a cathode, is disposed within the cathode cylinder and includes a filament that is connected to an electrical power source such that the supply of electrical power to the filament causes the filament to generate electrons by the process of thermionic emission. The anode is disposed in the anode housing in a spaced apart arrangement with respect to the cathode. The anode includes a target surface, sometimes referred to as a "target track" or "focal track," oriented to receive electrons emitted by the cathode. Typically, the target surface is composed of a material having a relatively high atomic number, such as tungsten, so that a portion of the kinetic energy of the striking electron stream is converted to electromagnetic waves of very high frequency, namely, x-rays.

In operation, the electrons are rapidly accelerated from the cathode to the anode under the influence of a high electric potential between the cathode and the anode that is created in connection with a suitable voltage source. The accelerating electrons then strike the target surface at a high velocity. The resulting x-rays emanate from the target surface, and are then collimated through a window formed in the x-ray device for penetration into an object, such as the body of a patient. The x-rays that pass through the object can then be detected and analyzed so as to be used in any one of a number of applications, such as x-ray medical diagnostic examination or material analysis procedures.

A relatively large percentage of the electrons that strike target surface of the anode do not cause the generation of x-rays however and, instead, simply rebound from the target surface. Such electrons are sometimes referred to as "backscatter" or "rebound" electrons. In some x-ray tubes, some of these rebounding electrons are blocked and collected by an electron collector that is positioned between the cathode and the anode so that rebounding electrons do not re-strike the target surface of the anode. In general, the electron collector thus prevents the rebounding electrons from re-impacting the target anode and producing "off-focus" x-rays, which can negatively affect the quality of the x-ray image.

Typically, such electron collectors define an aperture through which the emitted electrons pass from the cathode to the target surface of the anode. To this end, the aperture includes or defines an inlet positioned near the cathode, as well as an outlet positioned near the target surface of the anode. In at least one implementation, the aperture is configured so that the inlet has a diameter that is relatively larger than the diameter of the outlet.

While such electron collectors have proven useful in some applications, some problems nonetheless remain. For example, the geometry of some electron collectors is such that the electron collector experiences undesirable heat concentrations. Such heat concentrations can cause, among other things, thermal stress and strain that may ultimately contribute to structural failure of the collector. More particularly, non-uniform thermal expansion of structural elements, such as is produced by high temperature differentials, induces destructive mechanical stresses and strains that can ultimately cause a mechanical failure in the part.

Yet other concerns with some typical electron collectors relate to the heat flux distribution associated with the electron collector. In particular, the heat flux distribution within typical electron collectors is generally non-uniform. As a result, such electron collectors are prone to heat concentrations that impose harmful, and potentially destructive, thermally-induced stresses and strains on the electron collector, as well as on other components of the x-ray device. Further, such heat concentrations tend to diminish the efficiency and effectiveness with which heat can be removed from typical electron collectors.

Finally, x-ray devices that incorporate or include an electron collector typically lack devices or systems that are effective in guiding an electron beam through the electron collector and/or adjusting the position of the focal spot on the target track of the anode. Consequently, the tomographic, and other, information that can be obtained in connection with such fixed focal spot type devices is somewhat limited. Moreover, the target track of the anode may experience premature wear and failure as a result of the continued presence of the focal spot at the same location on the target track.

In view of the foregoing, and other, problems in the art, what is needed is a shield structure and focal spot control assembly that includes a shield structure configured and arranged such that heat flux distribution is substantially uniform throughout the interior surface of the shield structure. Additionally, the shield structure and focal spot control assembly should incorporate systems and devices that enable control of the location of the focal spot.

BRIEF SUMMARY OF AN EXEMPLARY EMBODIMENT OF THE INVENTION

In general, embodiments of the invention are concerned with a shield structure and focal spot control assembly having a shield structure configured to contribute to the attenuation of heat concentrations in x-ray devices. The shield structure and focal spot control assembly additionally includes a magnetic device configured and arranged to guide an electron beam through the shield structure and, further, to enable control of the location of the electron beam focal spot on a target track of the anode.

In one exemplary embodiment of the invention, a shield structure is provided that is configured to be interposed between a cathode and anode of an anode-grounded x-ray device. In this exemplary implementation, the anode of the x-ray device is a rotating anode. The shield structure defines a chamber through which the electrons are passed from the cathode to the target surface of the anode, and the shield structure further defines an inlet throat and an outlet throat in communication with the chamber. In this exemplary implementation, the inlet and outlet throats, as well as the chamber, have substantially circular cross-sections and, further, the inlet and outlet throats each have a maximum diameter that is less than a maximum diameter of the chamber.

In addition to the shield structure, the shield structure and focal spot control assembly further includes a magnetic device, exemplarily implemented as a magnetic coil, that is situated proximate the inlet throat of the shield structure. More particularly, the magnetic device is positioned so that a field generated by the magnetic device is able to influence the travel path of electrons emitted by the cathode of the x-ray device.

In operation, electrons generated by the cathode pass first through the inlet throat of the shield structure, through the chamber and then through the outlet throat of the shield structure, striking the target surface of the anode. At the same time, the magnetic device generates a magnetic field of desired strength and orientation so that a substantial portion of the emitted electrons follow a prescribed path to the target surface of the anode.

At least some of the emitted electrons rebound from the anode and pass back through the outlet throat of the shield structure, striking the inside of the chamber. As a result of the geometry and arrangement of the chamber of the shield structure however, the heat generated as a result of the collision of such rebound electrons with the interior of the chamber is distributed relatively uniformly over the walls of the chamber. Such heat can then be efficiently removed, for example, through the use of an external cooling system that directs a flow of coolant into contact with the shield structure.

In this way, exemplary embodiments of the invention facilitate, among other things, attenuation of heat concentrations in the shield structure, and effective and reliable control of the focal spot location on the target track of the anode. These and other, aspects of embodiments of the present invention will become more fully apparent from the following description and appended claims.

BRIEF DESCRIPTION OF THE DRAWINGS

In order that the manner in which the above-recited and other aspects of the invention are obtained, a more particular description of the invention briefly described above will be rendered by reference to specific embodiments thereof which are illustrated in the appended drawings. Understanding that these drawings depict only typical embodiments of the invention and are not therefore to be considered limiting of its scope, the invention will be described and explained with additional specificity and detail through the use of the accompanying drawings in which.

DETAILED DESCRIPTION OF SELECTED EMBODIMENTS OF THE INVENTION

Figure 1:
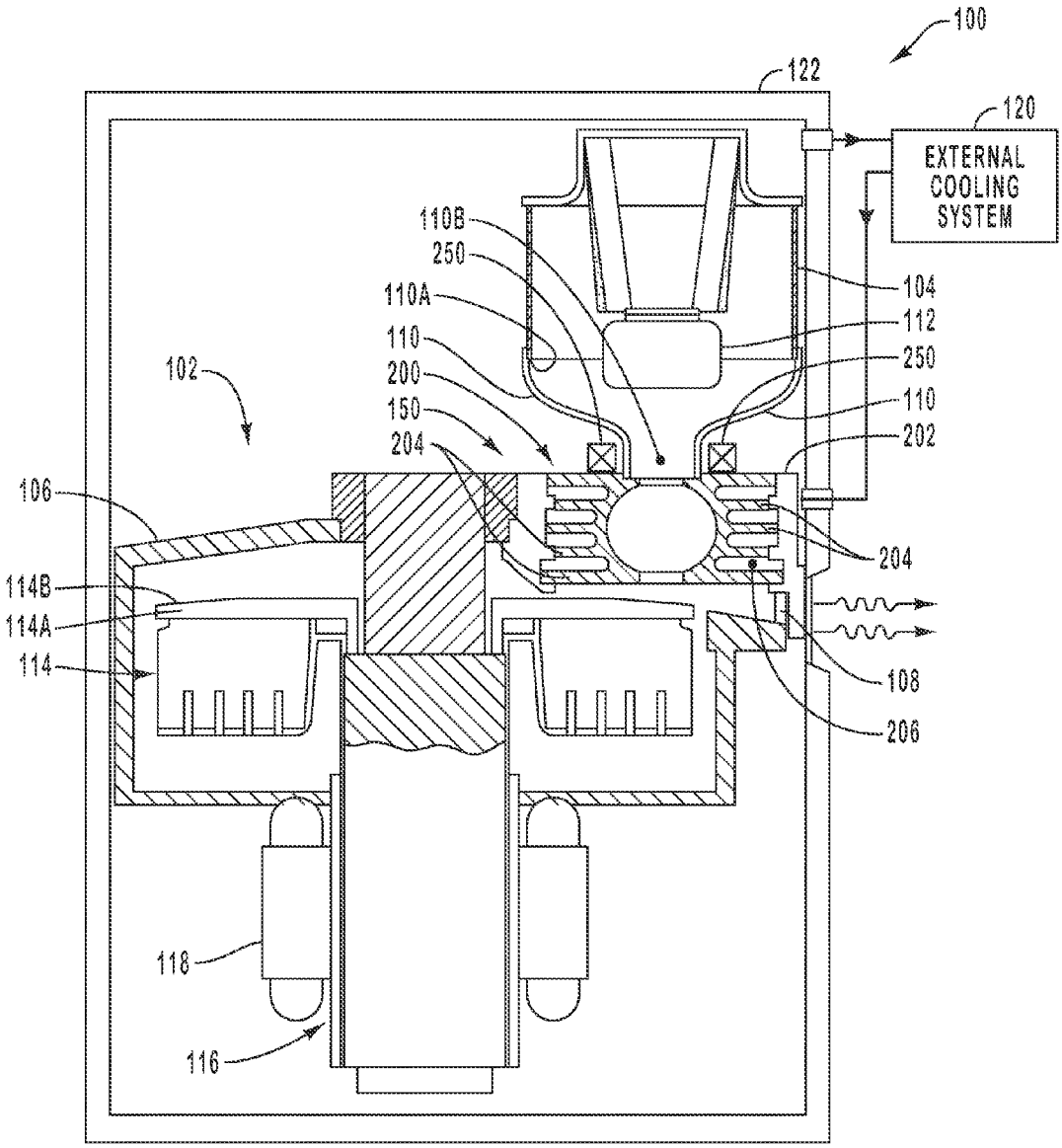
FIG. 1 is top view illustrating aspects of an exemplary shield structure and focal spot control assembly as employed in connection with an x-ray device.

Reference will now be made to the drawings to describe various aspects of exemplary embodiments of the invention. It is to be understood that the drawings are diagrammatic and schematic representations of such exemplary embodiments, and are not limiting of the present invention, nor are they necessarily drawn to scale.

In general, embodiments of the invention are concerned with a shield structure and focal spot control assembly having a shield structure configured to contribute to the attenuation of heat concentrations in x-ray devices, such as anode-grounded x-ray tubes for example. As discussed in further detail below, it is desirable in some applications and operating environments to be able to achieve a relatively even heat flux distribution over the interior surface of the shield structure chamber. Among other things, a relatively even heat flux distribution contributes to a relative improvement in heat transfer associated with the electron collector, since heat concentrations are attenuated or eliminated.

Exemplary implementations of the shield structure and focal spot control assembly additionally include a magnetic device configured and arranged to guide an electron beam through the shield structure and, further, to enable control of the location of the electron beam focal spot on a target track of the anode. Among other things, the ability to control, and adjust, the location of the focal spot enables generation of tomographic information beyond that which can be readily obtained with known x-ray devices configured for fixed focal spot operations. This additional tomographic information enables the user of the x-ray device to obtain improved radiological information that can then be employed in performing various analyses and evaluations.

I. Aspects of an Exemplary Operating Environment for the Shield Structure and Focal Spot Control Assembly Directing particular attention now to FIG. 1, details are provided concerning various aspects of an x-ray device, denoted generally at 100, wherein exemplary embodiments of a shield structure and focal spot control assembly 150 may be employed. The illustrated implementation of the shield structure and focal spot control assembly 150 includes a shield structure 200 and magnetic device 250, both of which are discussed in further detail below. In at least some implementations, the x-ray device 100 takes the form of an anode-grounded x-ray device where the anode is held at ground potential and the cathode has a potential of −140 KV, for example. Of course, embodiments of the invention may be employed in connection with anode-grounded devices of other potentials as well and, further, may be employed in other than anode-grounded x-ray devices. Accordingly, the scope of the invention should not be construed to be limited to any particular type(s) of x-ray device.

Moreover, while exemplary embodiments of the shield structure and focal spot control assembly 150 are well-suited for use in connection with rotating anode type x-ray devices, the scope of the invention is not so limited. Rather, embodiments of the shield structure and focal spot control assembly 150 may be employed in any application where the functionality disclosed herein would prove useful.

The illustrated implementation of the x-ray device 100 includes a vacuum enclosure 102 cooperatively defined, at least in part, by a cathode can 104 and an anode housing 106. A window 108, substantially composed of beryllium or other suitable material, in the vacuum enclosure 102 allows generated x-rays to pass out of the x-ray device 100.

An adapter 110 is also provided that is configured to mate with the open end of the cathode can 104. In the illustrated implementation, the adapter 110 defines a socket 110A configured to receive a portion of the cathode can 104. The adapter 110 and cathode can 104 may be joined together by any suitable process including, but not limited to, brazing, butt welding, or socket welding. As indicated in FIG. 1, the socket 110A in this exemplary embodiment has a diameter relatively larger than the diameter of the necked portion 110B of the adapter 110. Further details concerning the diameter of the necked portion 110B of the adapter 110 as such diameter relates to the shield structure 200 are provided below.

Within continuing reference to FIG. 1, a cathode 112 is provided that is disposed within the cathode can 104. The cathode 112 includes a filament (not shown) configured for connection to an electrical power source (not shown) such that when power from the electrical power source is supplied to the filament, electrons are emitted from the filament by thermionic emission. The cathode 112, as well as the anode (discussed below), is also configured for connection with a high voltage source.

The x-ray device 100 further includes a rotating type anode 114 that includes a substrate 114A upon which is disposed the target surface 114B, exemplarily composed of tungsten or other suitable material(s). The anode 114 is rotatably supported by a bearing assembly 116, and a stator 118 is provided that, when energized, causes the anode 114 to rotate at high speed. In the exemplary illustrated arrangement, only the anode 114 and bearing assembly 116 are disposed in the anode housing 106, while the stator 118 is positioned outside the anode housing 106.

Finally, an external cooling system 120 is provided that is in fluid communication with a coolant reservoir 122 containing coolant wherein at least a portion of the vacuum enclosure 102 is immersed. The external cooling system 120 is also configured and arranged for fluid communication with the shield structure 200, as discussed in further detail elsewhere herein.

With continuing attention to FIG. 1, the shield structure 200 is interposed between the cathode 112 and the anode 114. In the exemplary illustrated implementation, the shield structure 200 cooperates with the cathode can 104 and the anode housing 106 to define the vacuum enclosure 102. In at least some implementations, the shield structure 200 is substantially circular, but may be implemented in other shapes as well such as a square, rectangle, or oval for example.

In general, the shield structure 200 is configured to pass electrons emitted by the cathode 112 to the target surface 114B of the anode 114. At least some implementations of the shield structure 200 define, or otherwise incorporate or include, one or more fluid passageways through which coolant is passed so as to remove heat from the shield structure 200. In particular, exemplary implementations of the shield structure 200 additionally, or alternatively, include various structural elements, such as extended surfaces 204, configured and arranged to cooperate with other structures such as, but not limited to, the housing 202, adapter 108, anode housing 106 and/or other structures, to define one or more fluid passageways 206 through which a coolant is circulated. Examples of such structural elements and aspects, as employed in connection with a shield structure, are disclosed and claimed in U.S. Pat. No. 6,250,799, entitled X-RAY TUBE COOLING SYSTEM, and issued to Andrews on Jun. 4, 2002, and incorporated herein in its entirety by this reference.

II. Aspects of Exemplary Implementations of the Shield Structure and Focal Spot Control Assembly Directing attention now to FIGS. 2 and 3, and with continuing attention to FIG. 1, further details are provided concerning an exemplary implementation of a shield structure, denoted generally at 300 in FIGS. 2 and 3. Exemplary embodiments of the shield structure 300 are substantially composed of copper or a copper alloy. Any other suitable material(s) may likewise be employed however. Moreover, the shield structure 300 is, in some exemplary implementations, integral with the cathode can 104, adapter 110 or the anode housing 106. Accordingly, the scope of the invention should not be construed to be limited to any particular implementation of the shield structure 300.

Embodiments of he shield structure may be manufactured in a variety of different ways. For example, some implementations of the shield structure are formed by casting. Yet other implementations of the shield structure are produced with a milling machine, such as a 4 axis milling machine for example.

The shield structure 300 includes a body 302 that defines a chamber 304 having an interior surface 305. The chamber 304 generally is configured to allow the electron stream to pass from the cathode 112 to the target surface 114B of the anode 114 (see FIG. 1). The chamber 304 communicates with an inlet throat 304A and an outlet throat 304B, also defined by the body 302. Adjacent the inlet throat 304A a socket 304C is defined that is configured to receive a portion of the adapter 110. In other implementations, no socket 304C is required.

In the illustrated implementation of the shield structure 300, the chamber 304, inlet throat 304A, outlet throat 304B and socket 304C each have a substantially circular cross-sectional shape, although alternative geometries may be employed. For example, in some implementations, one or more of the chamber 304, inlet throat 304A, outlet throat 304B and socket 304C have a non-circular geometry, such as an oval shape. Further, while the illustrated embodiment indicates an arrangement where the chamber 304, inlet throat 304A, outlet throat 304B and socket 304C are each substantially coaxial with each other, the scope of the invention is not so limited. Rather, one or more of the chamber 304, inlet throat 304A, outlet throat 304B and socket 304C may be arranged to be non-coaxial relative to the other(s).

Other aspects of the geometry of the exemplary shield structure 300 vary as well. For example, in the implementation illustrated in FIGS. 2 and 3, the shield structure 300 is configured to interface with an adapter 110 having an inside diameter "a." Further, the shield structure 300 defines or embodies various parameters, including at least three characteristic diameters whose values may be adjusted to suit the requirements of a particular application.

In particular, the shield structure 300 defines an inlet throat diameter "b," a maximum chamber diameter "c," and an outlet throat diameter "d." In at least some implementations, the respective values of the aforementioned diameters, as well as the ratio of one or more diameters relative to another, are selected so as to facilitate achievement of a desired effect, such as a relatively uniform heat flux distribution over the interior surface of the chamber 304. Such diameters, and/or other aspects of the shield structure, may be selected and implemented to enable achievement of other thermal effects as well.

For example, adjustment of the outlet throat diameter enables control of the number of rebound electrons that will enter the chamber. Similarly, adjustment of the inlet throat diameter enables control of the number of rebound electrons that will exit the chamber near the cathode. As another example, changes to the geometry and/or size of the interior surface of the chamber, either alone or in combination with changes to one or both of the throat diameters, can be used to adjust the heat flux distribution within the chamber.

Thus, the particular values selected for design parameters such as the c/d ratio of the shield structure 300 for example, and the "a" and "b" dimensions, may depend upon a host of factors which include, but are not limited to, the operating temperature of the x-ray device, the amount of time taken to run up to operating temperature, the number of exposures made with a particular x-ray device over a predefined period of time, the intensity of the exposures made with the x-ray device, the operating time of the x-ray device, the age of the x-ray device, the material of the shield structure, the vacuum within the evacuated enclosure, and the rate at which heat can be transferred from the shield structure.

As the foregoing suggests, the designer has considerable latitude as to the values selected for the various parameters of the shield structure. Accordingly, the scope of the invention should not be construed to be limited to any particular implementation of the shield structure, nor to any particular design parameter value or group of values.

In the illustrated implementation, for example, the inlet throat diameter "b" is selected to be smaller than the adapter inside diameter "a." Additionally, the outlet throat diameter "c" is selected to be greater than both the inlet throat diameter "b" and the adapter diameter "a." Finally, the maximum chamber diameter "c" is greater than the adapter inside diameter "a," the inlet throat diameter "b," and the outlet throat diameter "c." The specific ratio of any given diameter to one or more other diameters may be selected as desired.

For example, the ratio of c/d may be adjusted as desired to facilitate achievement of a desired heat flux distribution within the chamber 304. As another example, FIGS. 5 and 6, discussed below, illustrate aspects of a shield structure implementation where the inlet throat diameter "b" and outlet throat diameter "c" are substantially equal, but are less than the maximum chamber diameter "c."

It should be noted that in the more general case, where one or more of the chamber 304, inlet throat 304A, outlet throat 304B and socket 304C has other than a substantially circular cross-sectional shape, the relationships between the adapter, inlet throat, outlet throat, and chamber can be expressed in terms of respective cross-sectional areas, rather than in terms of respective diameters.

Figure 2:
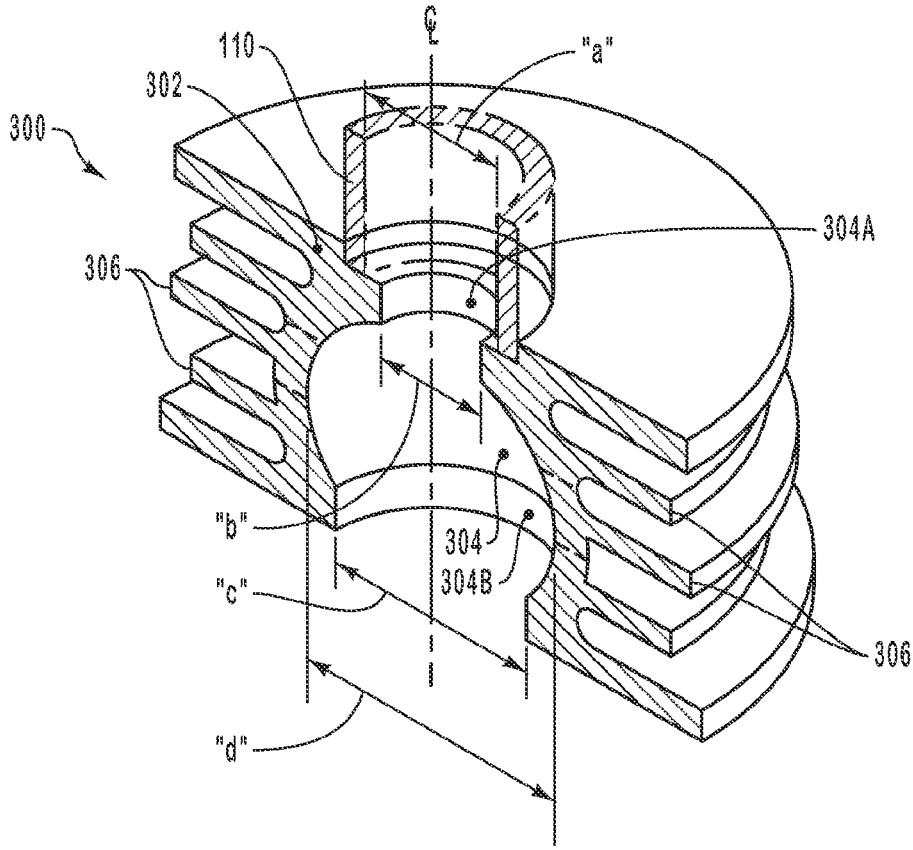
FIG. 2 is a perspective view illustrating aspects of an exemplary implementation of a shield structure that includes a plurality of extended surfaces.
Figure 3:
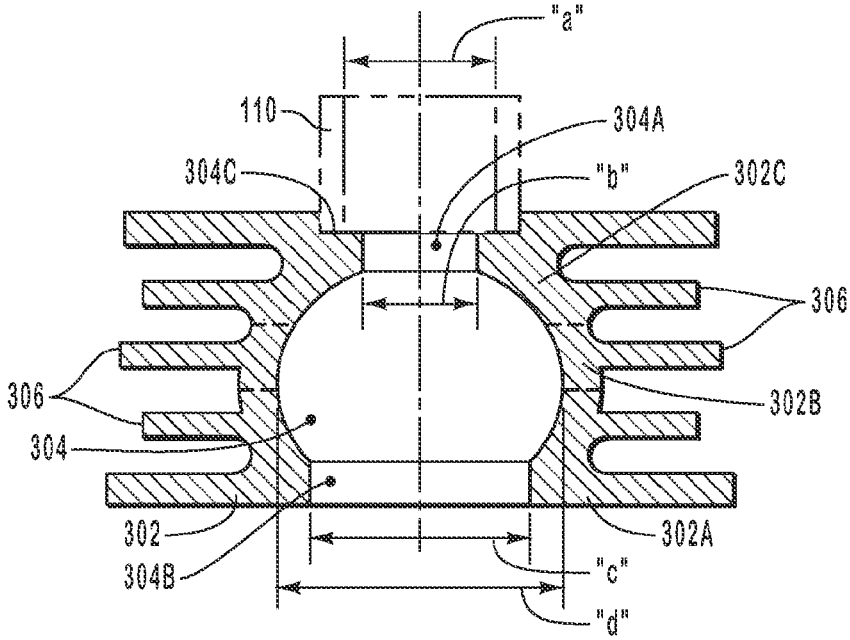
FIG. 3 is a section view of the shield structure illustrated in FIG. 2.

With continuing reference now to FIGS. 2 and 3, the exemplary shield structure 300 further includes one or more extended surfaces 306 attached to the body 302. In the illustrated implementation, a plurality of extended surfaces 306 are provided that are substantially circular and are arranged annularly about the body 302. In the illustrated embodiment, each of the extended surfaces 306 defines a substantially rectangular cross-section, but the scope of the invention is not so limited. Rather, aspects such as, but not limited to, the size, shape, spacing, arrangement and orientation of the extended surface(s) 306 may be varied as necessary to suit the requirements of a particular application.

Figure 4:
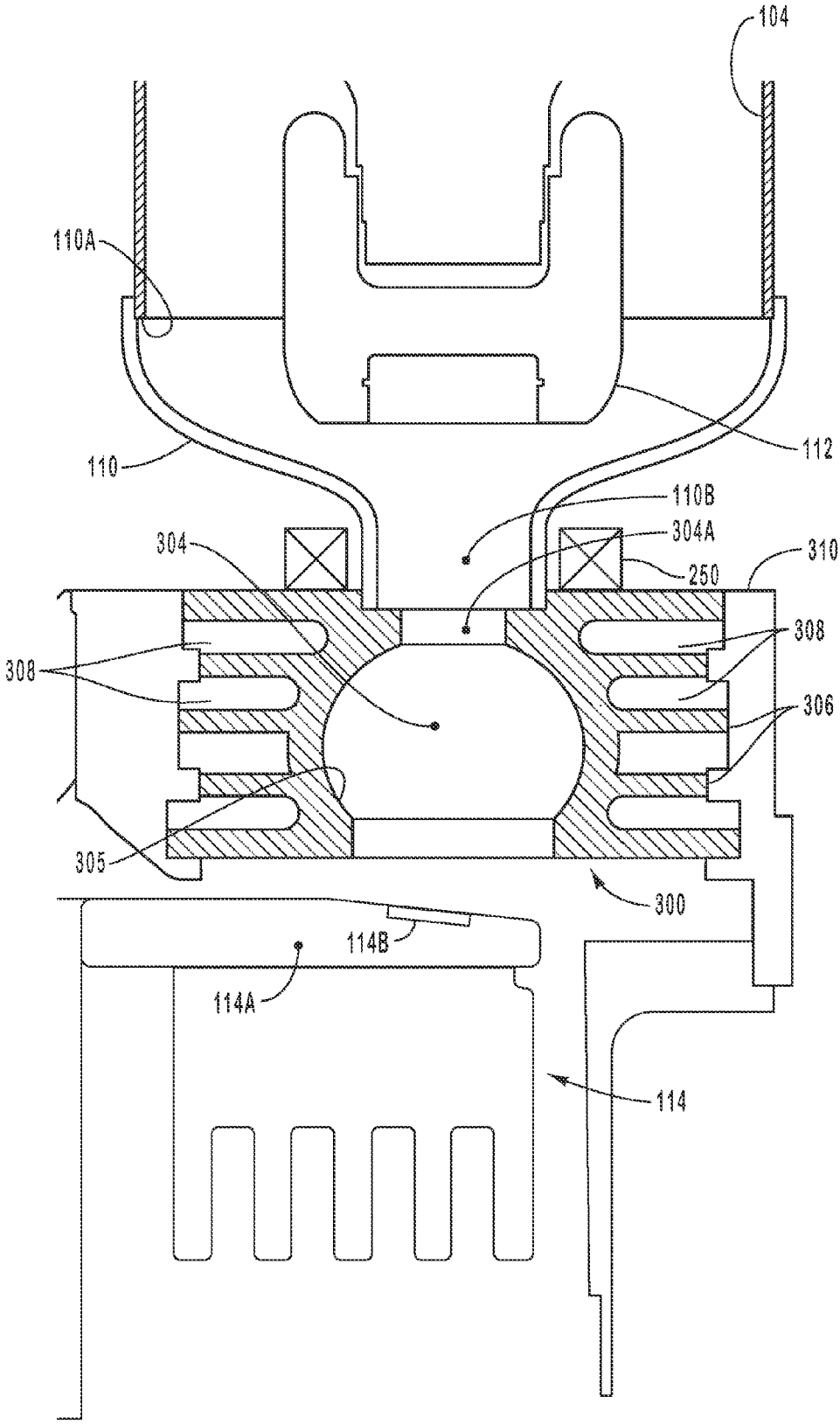
FIG. 4 is a partial section view illustrating aspects of an alternative implementation of a shield structure and focal spot control assembly.

As indicated in FIG. 4, for example, the extended surfaces 306 cooperate with each other to at least partially define one or more fluid passageways 308. In at least some of such implementations, the fluid passageways 308 are cooperatively defined by the extended surfaces 306 of the shield structure 300 and the anode housing 106. In yet other implementations, a housing 310 is provided that cooperates with the extended surfaces 306 to at least partially define the fluid passageway(s) 308. The housing 310 comprises a discrete component in some implementations, but is integral with the anode housing 106 in other implementations.

In any case, the fluid passageways 308 are configured and arranged to allow a flow of coolant, generated and provided by a suitable cooling system (FIG. 1) to be directed into contact with portions of the shield structure 300 so as to effect cooling, such as by convection and/or conduction for example, of the shield structure 300. To this end, exemplary implementations of the shield structure 300 further define, or otherwise include, at least one coolant inlet port and at least one coolant outlet port (not shown), both of which are in fluid communication with the fluid passageway(s) 308. As noted elsewhere herein, the shield structure 300 is connected with an external cooling system in some implementations.

Finally, the shield structure 300 may be constructed in a variety of different ways. In the exemplary implementation illustrated in FIG. 3 (see FIG. 6 also), the body 302 includes three discrete portions 302A, 302B and 302C which are formed, such as by machining and/or other suitable processes. After the three portions 302A, 302B and 302C have been constructed, they are stacked as shown, aligned, and then attached to each other by brazing, welding or any other suitable process.

With continuing attention to FIG. 4, the illustrated implementation of the shield structure and focal spot control assembly 200 includes in addition to the shield structure 300, a magnetic device 250, such as a B-field generator. As discussed in further detail below, the magnetic device 250 generally enables control and adjustment of the location of the focal spot on the target surface 114B of the anode 114.

The magnetic device 250 may be implemented in a variety of ways. For example, the magnetic device 250 is a permanent magnet in some implementations. Alternatively, the magnetic device 250 may be implemented as an electromagnet in other implementations. Further, the magnetic device 250 can be implemented as a single magnet, or multiple magnets. Additionally, aspects such as, but not limited to, the size, number, configuration, type and strength of magnetic device(s) 250 may be varied as necessary to suit the requirements of a particular application.

In the case where the magnetic device is implemented as a magnetic coil, for example, rapid energizing and de-energizing of the coil causes the position of the focal spot to change. Alternatively, the same result can be achieved by rapidly reversing the polarity of the voltage applied to the magnetic coil.

In connection with the foregoing, it should be noted that electromagnets, permanent magnets, magnetic coils and, more generally, the magnetic device, comprise exemplary structural implementations of a means for generating a magnetic field. Accordingly, any other structure(s) capable of implementing comparable functionality may likewise be employed.

As indicated in FIG. 4, the magnetic device 250 is exemplarily disposed about the necked portion 110B of the adapter 110, proximate the inlet throat 304A of the shield structure 300. Thus arranged, the magnetic device 250 is able to influence the travel path of electrons emitted by the cathode 112, and thereby facilitate control of the position of the focal spot. It should be noted that the arrangement in FIG. 4 is exemplary only however. More generally, the magnetic device(s) 250 may be located and oriented in any other way that would be conducive to implementation of focal spot control.

Figure 5:
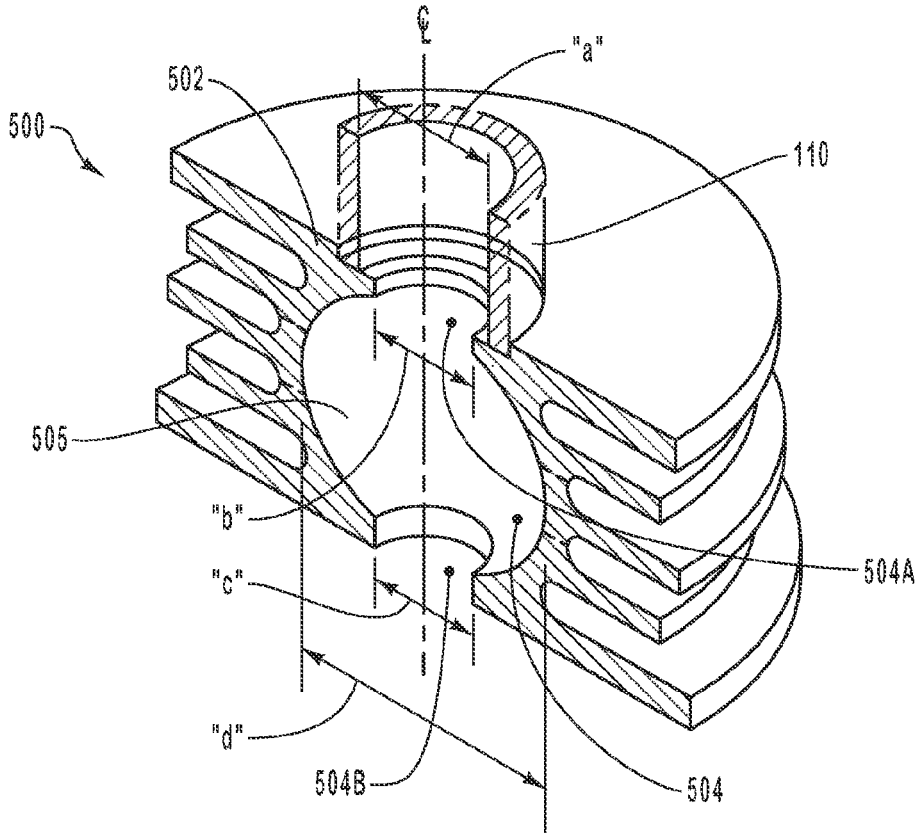
FIG. 5 is a perspective view illustrating aspects of an alternative implementation of a shield structure that includes a plurality of extended surfaces.
Figure 6:
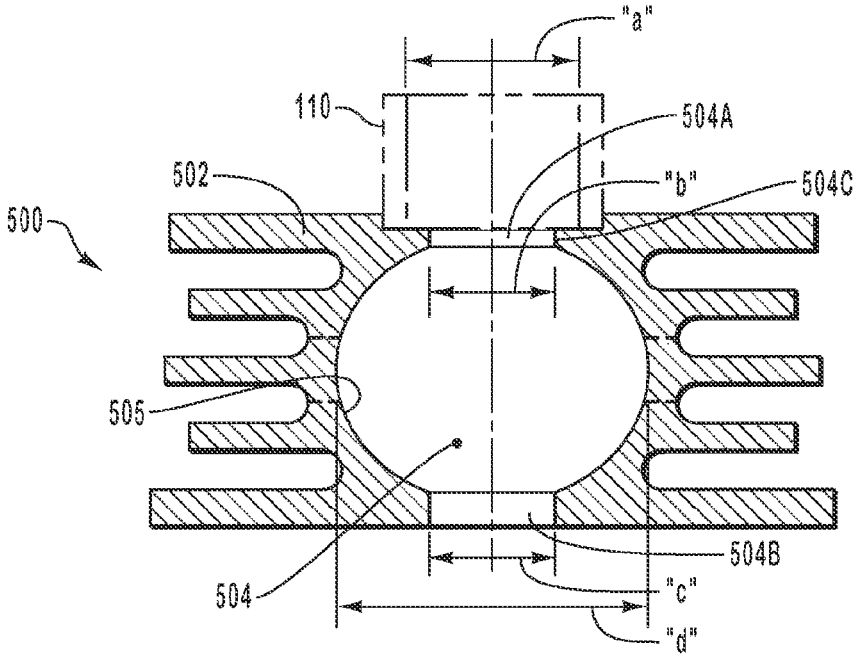
FIG. 6 is a section view of the shield structure illustrated in FIG. 5.

Directing attention now to FIGS. 5 and 6, details are provided concerning H various aspects of an alternative implementation of a shield structure, denoted generally at 500. As the shield structure 500 is similar in many regards to the shield structure 300 illustrated in FIGS. 2 and 3, the discussion of FIGS. 5 and 6 will focus primarily on certain differences between the two embodiments.

Similar to the shield structure 300, the shield structure 500 includes a body 502 that defines a chamber 504 having an interior surface 505. Generally, the chamber 504 is configured to allows the electron stream to pass from the cathode 112 to the target surface 114B of the anode 114 (see FIG. 1). The chamber 504 communicates with an inlet throat 504A and an outlet throat 504B, also defined by the body 502. Adjacent the inlet throat 504A, a socket 504C is defined that is configured to receive a portion of the adapter 110 having an inside diameter "a."

As in the case of the shield structure 300, the shield structure 500 defines an inlet throat diameter "b," a maximum chamber diameter "c," and an outlet throat diameter "d." In at least some implementations, the respective values of the aforementioned diameters, as well as the ratio of one or more diameters relative to another, are selected so as to facilitate achievement of a relatively uniform heat flux distribution over the interior surface of the chamber 504. Such diameters, and/or other aspects of the shield structure, may be selected and implemented to enable achievement of other thermal effects as well.

In the illustrated implementation, the inlet throat diameter "b" is selected to be smaller than the adapter inside diameter "a." In contrast with the shield structure 300 however, the outlet throat diameter "c" of the shield structure 500 is selected to be substantially the same size as the inlet throat diameter "b," while both the outlet throat diameter "c" and inlet throat diameter "b" are smaller than the maximum chamber diameter "c." Of course, the specific ratio of any given diameter to one or more other diameters may be selected as desired. By way of example, the ratio of c/d may be adjusted as desired to facilitate achievement of a desired heat flux distribution within the chamber 504.

It should be noted that in the more general case, where one or more of the chamber 504, inlet throat 504A, outlet throat 504B and socket 504C has other than a substantially circular cross-sectional shape, the relationships between the adapter, inlet throat, outlet throat, and chamber can be expressed in terms of respective cross-sectional areas, rather than in terms of respective diameters.

Figure 7:
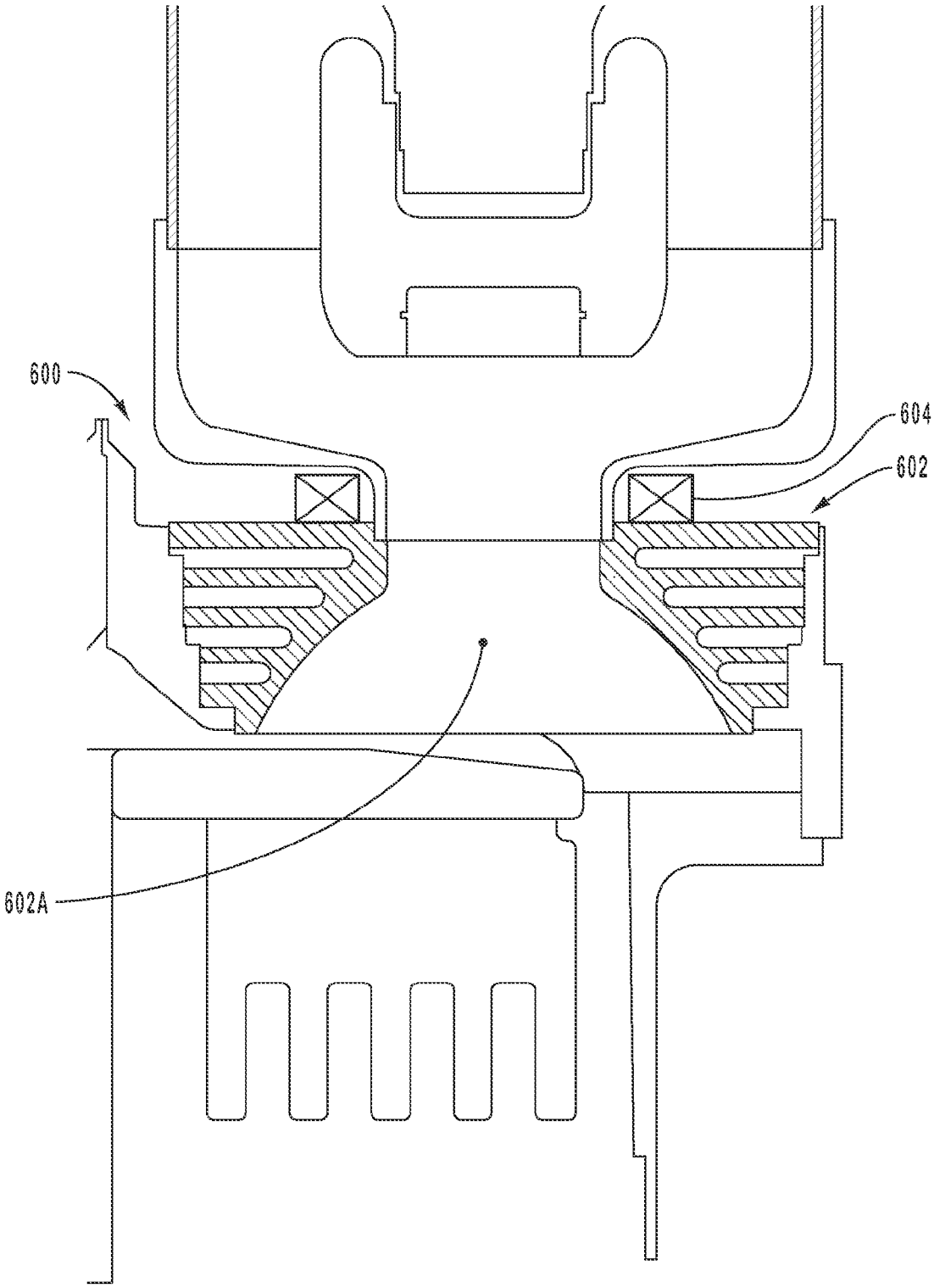
FIG. 7 is a section view illustrating an alternative implementation of a shield structure and focal spot control assembly as employed in connection with an x-ray device.

With attention now to FIG. 7, details are provided concerning an alternative implementation of a shield structure and focal spot control assembly, denoted generally at 600. The shield structure and focal spot control assembly 600 differs somewhat from other implementations disclosed herein in that the shield structure 602 does not include a chamber but, rather, has an interior surface that defines a substantially concave aperture 602A through which electrons pass from the cathode to the anode. Exemplary embodiments of such a shield structure 602 are disclosed and claimed in U.S. Pat. No. 7,058,160, entitled SHIELD STRUCTURE FOR X-RAY DEVICE, designated as Workman Nydegger Docket No. 14374.89, issued Jun. 6, 2006.

With continuing reference to FIG. 7, the shield structure and focal spot control assembly 600 further includes one or more magnetic device(s) 604, such as a B-field generator, configured and arranged to implement focal spot control functionality as disclosed herein. As in the case of the other magnetic devices disclosed herein, the magnetic device 604 is implemented, for example, as an electromagnet, magnetic coil, or as a permanent magnet. Further, the magnetic device 604 is implemented as a single magnet in some cases, or as multiple magnets. Additionally, aspects such as, but not limited to, the size, number, configuration, type and strength of magnetic device(s) 604 may be varied as necessary to suit the requirements of a particular application. The magnetic device(s) 604 may be located and oriented in any way that would be conducive to implementation of focal spot control.

III. Operational Aspects of an Exemplary Implementation of the Shield Structure and Focal Spot Control Assembly With continuing reference to the Figures, details are provided concerning various operational aspects of an exemplary implementation of a shield structure and focal spot control assembly, such as the shield structure and focal spot control assembly 200, as employed in an x-ray device operating environment.

In operation, power is applied to the cathode 112, and a high electric potential established between the cathode 112 and the anode 114. The power applied to the cathode 112 causes the thermionic emission of electrons from the cathode filament and the high voltage causes the electrons to accelerate rapidly toward the target surface 114B of the anode 114. As the electrons strike the target surface 114B, x-rays are produced that pass through the window 108.

At least some of the x-rays that strike the target surface 114B rebound from the target surface 114B toward the cathode 112 and/or other structures and elements of the x-ray device 100. As noted earlier, such rebound electrons still possess significant kinetic energy that is transformed to heat when the rebound electrons strikes a portion of the x-ray device 100.

However, the geometry of the shield structure 300 is such that selection of c/d ratio, in light of the applicable operating environment conditions and operational requirements, enables achievement of a substantially uniform heat flux distribution over a substantial portion of the interior surface of the chamber 304. For example, in some implementations, a c/d ratio of less than about 1.0 facilitates achievement of a substantially uniform heat flux distribution on the interior surface 305 of the chamber 304. Among other things, this substantially uniform heat flux attenuates undesirable heat concentrations within the shield structure 300 and also contributes to a relative improvement in the effectiveness and efficiency with which heat can be removed from the shield structure 300 by, for example, the external cooling system 120.

As disclosed elsewhere herein, modifications to the heat flux distribution, and/or implementation of other desired thermal effects can be readily achieved with appropriate modifications to one or more of the parameters of the shield structure. For example, the shield structure 500 is constructed with a throat outlet 504B having a relatively smaller diameter than the throat outlet of the shield structure 300. Thus, the shield structure 500 is configured to admit relatively fewer rebound electrons to the chamber 504, with an attendant decrease in heat flux through the interior surface 505.

With continuing reference to exemplary operational aspects of the shield structure and focal spot control assembly, the magnetic device generates a magnetic field of desired strength and orientation so that a substantial portion of the emitted electrons follow a prescribed path to the target surface of the anode. Because aspects such as the strength and orientation of the magnetic field exerted by the magnetic device can be adjusted, changes to the position of the focal spot can be readily implemented. Among other things, the ability to move the focal spot in this way enables the operator to gather relatively more tomographic information than would otherwise be possible. This additional information, in turn, contributes to a relative improvement in the evaluations and analyses that can be performed with the x-ray device.

The described embodiments are to be considered in all respects only as exemplary and not restrictive. The scope of the invention is, therefore, indicated by the appended claims rather than by the foregoing description. All changes which come within the meaning and range of equivalency of the claims are to be embraced within their scope.

What is claimed is:

1. An x-ray device, comprising:

a vacuum enclosure;

an anode and cathode substantially disposed in the vacuum enclosure in a spaced apart arrangement so that a target surface of the anode is positioned to receive electrons emitted by the cathode;

a shield structure interposed between the anode and the cathode, the shield structure defining a chamber through which the electrons are passed from the cathode to the target surface of the anode, and the shield structure further defining an inlet passageway and an outlet passageway in communication with the chamber; and a means for generating a magnetic field, the means operating to permit control and adjustment of the location of a focal spot on the target surface of the anode.

2. The x-ray device as recited in claim 1, wherein both the inlet passageway and the outlet passageway have a cross-sectional area less than a maximum cross-sectional area of the chamber.

3. The x-ray device as recited in claim 1, wherein the cross-sectional area of the inlet passageway is substantially the same as the cross-sectional area of the outlet passageway.

4. The x-ray device as recited in claim 1, wherein the cross-sectional area of the inlet passageway is less than the cross-sectional area of the outlet passageway.

5. The x-ray device as recited in claim 1, wherein the shield structure substantially comprises one of: copper; and, copper alloy.

6. The x-ray device as recited in claim 1, wherein the anode is at about ground potential during operation of the x-ray device.

7. The x-ray device as recited in claim 1, wherein the shield structure at least partially defines a fluid passageway.

8. The x-ray device as recited in claim 1, wherein the shield structure includes at least one extended surface.

9. The shield structure as recited in claim 8, wherein the at least one extended surface comprises a plurality of substantially annular extended surfaces.

10. The x-ray device as recited in claim 1, wherein the means for generating a magnetic field comprises at least one magnetic device disposed proximate the inlet passageway of the shield structure.

11. The x-ray device as recited in claim 1, further comprising a housing within which at least a portion of the shield structure is received.

12. The x-ray device as recited in claim 1, wherein the chamber is configured to provide an interior electron collection surface that is oriented towards the target surface of the anode.

* * * * *

UNITED STATES PATENT AND TRADEMARK OFFICE

CERTIFICATE OF CORRECTION

PATENT NO. : 7,486,776 B2
APPLICATION NO. : 11/751603
DATED : February 3, 2009
INVENTOR(S) : Gregory C. Andrews It is certified that error appears in the above-identified patent and that said Letters Patent is hereby corrected as shown below:

Column 6
Line 23, change "of he shield" to --of the shield--
Line 30, remove "305"
Line 61, change "chamber diameter "c," and an outlet throat diameter "d."" to --chamber diameter "d," and an outlet throat diameter "c."--

Column 7
Line 36, change "chamber diameter "c"" to --chamber diameter "d"--
Line 46, change "chamber diameter "c"" to --chamber diameter "d"--

Column 8
Lines 4 and 9, remove "106"
Line 33, remove "200"

Column 9
Line 5, change "concerning H various aspects" to --concerning various aspects--
Line 23, change "chamber diameter "c," and an outlet throat diameter "d."" to --chamber diameter "d," and an outlet throat diameter "c."--
Line 39, change "chamber diameter "c."" to --chamber diameter "d."--

Column 10
Line 44, remove "305"

Signed and Sealed this

Third Day of August, 2010

David J. Kappos

David J. Kappos
*Director of the United States Patent and Trademark Office*